US011406190B2

(12) United States Patent
Jakubowski

(10) Patent No.: US 11,406,190 B2
(45) Date of Patent: Aug. 9, 2022

(54) RECLINER WITH EXTENDING STABILIZER ARMS

(71) Applicant: Direct Supply, Inc., Milwaukee, WI (US)

(72) Inventor: Joshua Jakubowski, Port Washington, WI (US)

(73) Assignee: Direct Supply, Inc., Milwaukee, WI (US)

( * ) Notice: Subject to any disclaimer, the term of this patent is extended or adjusted under 35 U.S.C. 154(b) by 0 days.

(21) Appl. No.: 17/155,388

(22) Filed: Jan. 22, 2021

(65) Prior Publication Data

US 2021/0274938 A1 Sep. 9, 2021

Related U.S. Application Data

(60) Provisional application No. 62/985,543, filed on Mar. 5, 2020.

(51) Int. Cl.

| | |
|---|---|
| ***A47B 67/04*** | (2006.01) |
| ***A47B 97/00*** | (2006.01) |
| ***A47K 1/04*** | (2006.01) |
| ***A47C 7/50*** | (2006.01) |
| ***A47C 1/027*** | (2006.01) |
| ***A47C 1/0355*** | (2013.01) |
| ***A47C 7/00*** | (2006.01) |

(52) U.S. Cl.

CPC ..... *A47C 1/0355* (2013.01); *A47B 97/00* (2013.01); *A47C 7/006* (2013.01); *A47B 2097/008* (2013.01)

(58) Field of Classification Search

CPC ..... B60N 2/753; B60N 2/767; A47C 1/023; A47C 1/03; A47C 7/506; A47C 7/54

See application file for complete search history.

(56) References Cited

U.S. PATENT DOCUMENTS

| | | | | |
|---|---|---|---|---|
| 7,871,046 | B2 * | 1/2011 | Munro | B65G 1/026 248/129 |
| 8,459,732 | B2 * | 6/2013 | LaPointe | A47C 1/0355 297/85 M |
| 9,861,194 | B1 * | 1/2018 | Park | A47B 97/00 |
| 10,820,708 | B2 * | 11/2020 | LaPointe | A47C 1/0355 |
| 2007/0132292 | A1 * | 6/2007 | Robertson | A47C 7/506 297/330 |
| 2015/0076891 | A1 * | 3/2015 | LaPointe | A61G 5/14 297/85 M |
| 2015/0359692 | A1 * | 12/2015 | Elnatan | A61G 5/12 297/183.1 |
| 2019/0082837 | A1 * | 3/2019 | Kim | A47B 97/00 |

(Continued)

OTHER PUBLICATIONS

Dalcross, Jan. 9, 2019, https://web.archive.org/web/20190122090203/https:/www.dalcross.com.au/shop/healthcare-seating/recliner-chairs/premier-electric-auto-toggle-recliner/ (Year: 2019).*

(Continued)

*Primary Examiner* — Shin H Kim

(74) *Attorney, Agent, or Firm* — Boyle Fredrickson, S.C.

(57) ABSTRACT

A reclining chair or the like provides a set of base-mounted extendable arms that move forward as the chair reclines, and the leg rest extends to brace the chair against forward tipping, for example, if weight is applied to the leg rest without the counterbalance of an occupant. When the leg rest retracts, the arms pull back to reduce tripping hazard.

14 Claims, 9 Drawing Sheets

(56) References Cited

U.S. PATENT DOCUMENTS

| | | | | |
|---|---|---|---|---|
| 2019/0183248 | A1* | 6/2019 | Chen | A47B 97/00 |
| 2019/0350368 | A1* | 11/2019 | Lapointe | A47C 7/506 |
| 2020/0046119 | A1* | 2/2020 | Katayama | B65G 1/14 |
| 2020/0107641 | A1* | 4/2020 | Weldon | B62B 1/008 |
| 2020/0113333 | A1* | 4/2020 | Crum | A47C 1/0355 |
| 2020/0196759 | A1* | 6/2020 | Johnson | A47C 1/03211 |
| 2021/0274938 | A1* | 9/2021 | Jakubowski | A47B 97/00 |

OTHER PUBLICATIONS

Admitted prior art, copied from the website of Dalcross Medical Equipment company Narellan, Australia (https://www.dalcross.com.au/shop/healthcare-seating/recliner-chairs/premier-electric-auto-toggle-recliner/) Mar. 23, 2021.

* cited by examiner

RECLINER WITH EXTENDING STABILIZER ARMS

CROSS REFERENCE TO RELATED APPLICATION

This application claims the benefit of U.S. provisional application 62/985,543 filed Mar. 5, 2020, and hereby incorporated by reference.

STATEMENT REGARDING FEDERALLY SPONSORED RESEARCH OR DEVELOPMENT

--

BACKGROUND OF THE INVENTION

The present invention relates generally to recliner chairs and similar furniture providing a reclining seat back and forwardly extending footrest and, in particular, to a stabilizer system improving the stability of such furniture when the furniture is in the reclined position.

A common recliner chair provides an upwardly extending rear seat back that may be reclined by tipping backward with respect to the seat pan supporting the seated individual. Reclining motion of the seat back may be coordinated to a simultaneous elevation and extension of a footrest by means of a mechanical linkage between these two elements. As the seat back reclines and the footrest extends, the seat pan may also be tipped back slightly by the mechanical linkage so that the seated individual more closely approaches relaxing in a supine position.

The reclining mechanism may be operated by a lever communicating with the mechanical linkage. This lever may be positioned at a side of the seat pan, for example, outside the arms of the chair, to be operated by a seated individual and pulled to promote the reclining action. Alternatively, the reclining mechanism may be driven by a motor and controlled by the seated individual through a control pendant providing electrical switches controlling electrical current to the motor.

With so-called "wall-saver" reclining chairs, the reclining mechanism further moves the seat pan forward over a base that sits against the floor. Specifically, during the reclining action, the seat pan slides forward with respect to the base carrying with it the reclining seat back and footrest. In this way the reclining chair may be placed with its rear in closer proximity to a wall without the reclining of the seat back striking that wall during the reclining process.

Particularly when a wall saver design is used with a motor actuator, there can be an increased risk of instability in the chair if the seated individual attempts to exit the chair forward over the footrest. Forward movement of the seat pan with respect to the base during reclining moves the center of mass of the chair forward with respect to the base which can be further shifted as the individual attempts to disembark. In such cases, the natural resistance of the motorized mechanism resists returning the chair to an upright and more stable position, allowing the chair to tip forward in certain cases.

One method of addressing this problem is to substantially increase the weight of the base along its rear edge to shift the center of mass rearward. This approach, however, can undesirably increase the weight of the furniture which already contains substantial weight in the articulating mechanisms. Increasing the forward extent of the base could also be used to address this problem by keeping the center of mass in these cases within the perimeter of the base. This extension, however, could expose a portion of the base when the chair is upright presenting a possible tripping hazard.

The problem of such instability is particularly important with respect to individuals in an assisted living facility who may not be able to anticipate or understand these factors of chair instability. Unfortunately, this market may not be large enough to support a custom chair design, particularly if it requires costly modifications, to address this issue.

SUMMARY OF THE INVENTION

The present invention provides a lightweight stability solution that can be readily adapted or retrofit to common recliner chair mechanisms and thus which may greatly increase the accessibility of this stabilizing solution. In this regard, the invention provides extendable stabilizer arms that move forward from the base of the chair to contact the floor surface in front of the chair when the chair is in the retracted position. This extended contact ensures that the chair center of mass is stably located within the points of support of the chair against the floor for a wider range of occupant positions in entering and exiting the chair when reclined. In one embodiment, each stabilizer arm provides a self-contained slide that fits easily in available space flanking the drive motor used to drive the reclining mechanism and which may attach to that motor to provide automatic actuation during reclining.

More specifically, the invention provides a reclining chair of the type having a base frame and a seat pan, a seat back, and a leg rest mechanism supported by the base frame. The leg rest mechanism includes a leg rest platform movable relative to the base frame between a retracted position and an extended position extending forward from the base frame. The invention provides a pair of extendable arms each having distal ends movable between a retracted position and an extended position, the latter being forward from the base frame so that the distal ends contact a floor surface on which the base frame rests at left and right positions in front of the base frame to resist a forward and sideward tipping of the base frame on the floor.

It is thus a feature of at least one embodiment of the invention to provide a bracing system for retractable chairs that improves stability of the chairs if the occupant attempts to get out of the chair before retracting the leg rest. By employing separate arms, improved forward and lateral stability may be provided with a lightweight mechanism without the need for strong torsional resistance of the extending arms. It is another feature of at least one embodiment of the invention to minimize the risk of entrapment or pinching when the extension arms are retracted by eliminating a T-bar design or the like.

The arms may be attached to the base frame at left and right sides of the base frame to be closer to the left and right sides, respectively, than a midline of the base frame halfway between the left and right sides.

It is thus a feature of at least one embodiment of the invention to promote lateral stability as well as forward stability by increased separation between the arms.

The proximal and distal ends of the arms may be joined by a telescopic slide joint constraining motion of the distal ends in extension from the base frame along a line, and the proximal ends of the arms may be releasably attachable to the base frame.

It is thus a feature of at least one embodiment of the invention to provide a stabilizer arms system having a self-contained slide mechanism simplifying adaptation or retrofitting of existing reclining chairs.

The base frame may provide a front and rear bar element at the front and rear sides of the reclining chair, respectively, communicating on left and right edges with chair feet, and each of the proximal ends of the arms may attach to both the front and rear bar elements.

It is thus a feature of at least one embodiment of the invention to provide a stabilizer system well adapted to normal frame construction of the base frame to obtain substantial resistance to tipping forces by separated connection points on the structural members of the base frame.

The telescopic slide joints may inter-communicates between the proximal and distal ends of the arms with rollers guiding the distal end with respect to the proximal end.

It is thus a feature of at least one embodiment of the invention to provide a low-friction extension of the arms that may permit close contact of the distal ends of the arms during extension, for example, over carpet or the like which may present upward forces on the distal ends.

The rollers may be wheels turning about a central axle fixed with respect to one of the distal and proximal ends and having an outer periphery of an elastomeric material.

It is thus a feature of at least one embodiment of the invention to provide a low-friction mechanism providing extremely quiet operation through the use of elastomeric wheels.

The base frame may communicate through a linkage joining the seat back and footrest mechanism to move the seat back between a forward and reclined position and the leg rest platform between the retracted and extended position with motion of the traveler. The first and second arms may be attached to linkage to move in extension when the seat back moves to the reclining position and the footrest moves to the extended position.

It is thus a feature of at least one embodiment of the invention to automatically extend the arms when the footrest is in extension and additional stability is required.

The linkage may provide a motorized traveler moving along a traveler axis by actuation of a motor and wherein the first and second arms are attached to the traveler. It is thus a feature of at least one embodiment of the invention to provide a mechanism that can be readily adapted to motorized reclining chairs by communicating with a motorized traveler.

The first and second arms may be attached on opposite left and right sides of the traveler to extend along axes aligned with the traveler axis.

It is thus a feature of at least one embodiment of the invention to provide a mechanism that can be placed on opposite sides of the motorized traveler to provide good left and right stability and integrate with a center mounted traveler found in many current recliner designs.

The base frame may provide non-roller floor guides supporting the base frame against the floor, and the distal ends of the arms may provide rollers sized to provide rolling contact with the floor during extension.

It is thus a feature of at least one embodiment of the invention to minimize the gap between the floor and the distal ends of the arms for improved stability with reduced risk of floor damage or excessive resistance to extension caused by friction between the distal ends and the floor.

The retracted position of the distal ends may be beneath the seat pan. Alternatively, or in addition, the extended position may extend the distal ends of the arms at least 12 inches.

It is thus a feature of at least one embodiment of the invention to provide significant stability by substantial extension of the arms while minimizing tripping hazard from the extension legs when the chair is in the non-reclined position.

The invention may further include a skirt frame attached to the distal ends of the arms and providing a front panel extending perpendicularly to the arms and left and right side panels extending rearwardly from a left and right side of the front panel, the front panel moving proximate to a front of the base and the left and right side panels fitting around the left and right sides of the base when the arms are in the retracted position.

It is thus a feature of at least one embodiment of the invention to provide a visual curtain around the extendable arms improving the appearance of the reclining chair.

In one embodiment, the invention may provide a second pair of extendable arms having distal ends extendable to contact a floor surface behind the base frame on which the base frame rests to resist a rearward tipping of the base frame on the floor.

It is thus a feature of at least one embodiment of the invention to provide rearward stability against the chair falling backward from improper egress or ingress.

The first pair of extendable arms and second pair of extendable arms may be mechanically interlinked to move between extended and retracted positions in unison.

It is thus a feature of at least one embodiment of the invention to provide a simple modular system that can provide forward and backward stability with a single common point of actuation.

In an alternative embodiment, the invention may provide a reclining chair having a base frame with a seat pan, a seat back, and leg rest mechanism supported by the base frame. The leg rest mechanism may include a leg rest platform movable relative to the base frame between a retracted position and an extended position extending forward from the base frame. A panel is provided having a proximal edge attached to the base frame to move a distal edge of the panel between a retracted position and an extended position extending forward from the base frame so that the distal edge of the panel contacts a floor surface on which the base frame rests to resist a forward tipping of the base frame on the floor with a lower panel surface substantially abutting the upper surface of the floor and an upper panel surface substantially parallel to the floor.

It is thus a feature of at least one embodiment of the invention to provide a relatively low-profile panel for stabilizing the chair providing reduced interference with the feet of a user who is either entering or exiting the chair or the feet of a person who is assisting another person who is entering or exiting the chair.

In an alternative embodiment, the invention may provide a reclining chair having a base frame and a seat pan, a seat back, and leg rest mechanism supported by the base frame. The leg rest mechanism may provide a leg rest platform and include a pantograph linkage movable relative to the base frame between a retracted position and an extended position extending forward from the base frame to hold the leg rest platform in horizontal extension spaced away from the base frame in front of the base frame in the extended position and in vertical extension adjacent to the front of the base frame in the retracted position. A stilt may be attached to the leg rest mechanism to extend downward from the undersurface of the leg rest platform when the pantograph linkage is in the extended position to a point proximate to a floor supporting the base frame, the stilt adapted to resist a forward tipping of the base frame on the floor.

It is thus a feature of at least one embodiment of the invention to enlist the mechanism of the footrest to brace the chair against forward tipping.

These particular objects and advantages may apply to only some embodiments falling within the claims and thus do not define the scope of the invention.

DETAILED DESCRIPTION OF THE PREFERRED EMBODIMENT

Figure 1:
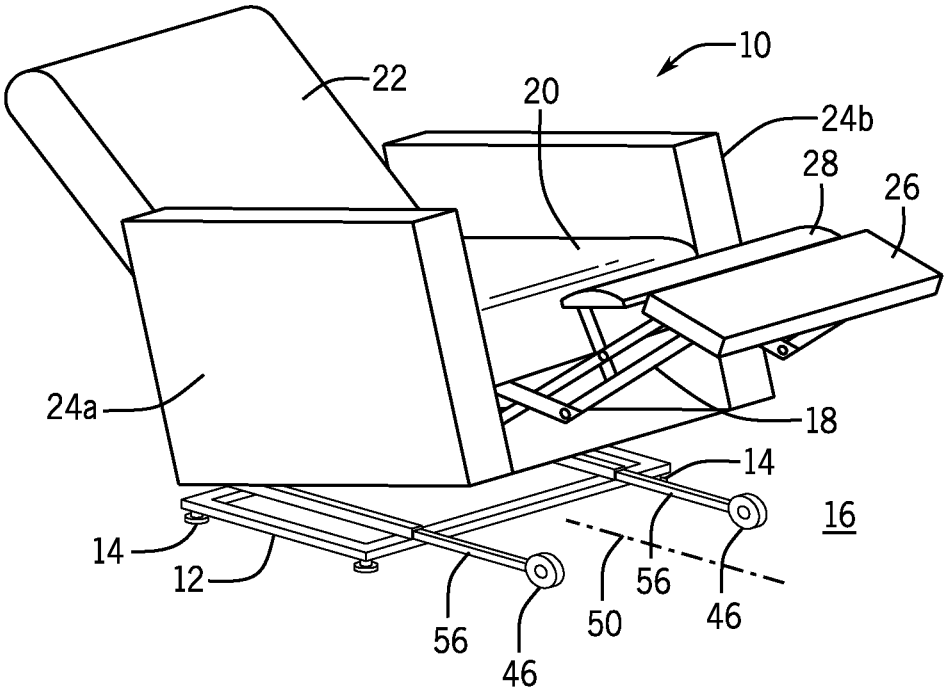
FIG. 1 is a perspective view of a reclining chair according to one embodiment of the present invention showing stabilizing arms extending along a forward axis during reclining of the chair.

Referring now to FIG. 1, a reclining chair 10 suitable for use with the present invention may include a base 12 supporting the chair 10 on a floor 16 such as a solid material, carpet, or the like. The base 12 may be a square or rectangular frame of steel or the like having downward feet 14 such as glides at its corners providing contact areas with the floor 16. In one embodiment, the base 12 may provide for left and right base bars 15*a* and 15*b* joining front and rear base bars 15*c* and 15*d* to form the rectangular frame.

The base 12 attaches to a recliner linkage 18 (shown in part) which in turn connects the base 12 to the remaining of the components of the chair including: a seat pan 20, a seat back 22, left and right arms 24*a* and 24*b*, a leg rest 26, and a calf rest 28. As is generally understood in the art, the seat pan 20 provides an upholstered upper surface for supporting a seated individual with the individual's back abutting an upholstered front surface of the seat back 22. As so seated, the individual's arms may rest on upper edges of the left and right arms 24*a* and 24*b* with the individual's calves and feet supported, respectively, on the calf rest 28 and leg rest 26.

Figure 2A:
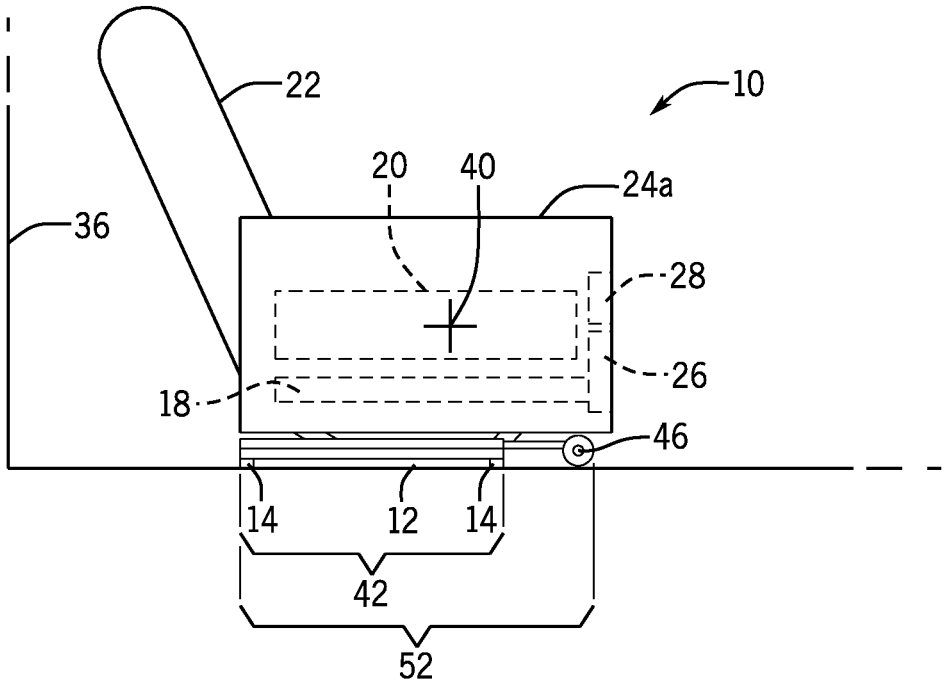
FIGS. 2*a* and 2*b* are side elevational views of the chair of FIG. 1 in an upright and reclined position, respectively, showing a forward shifting of the center of gravity of the chair with respect to the base as the chair reclines and a further shifting of the center of gravity as an individual disembarks.
Figure 2B:
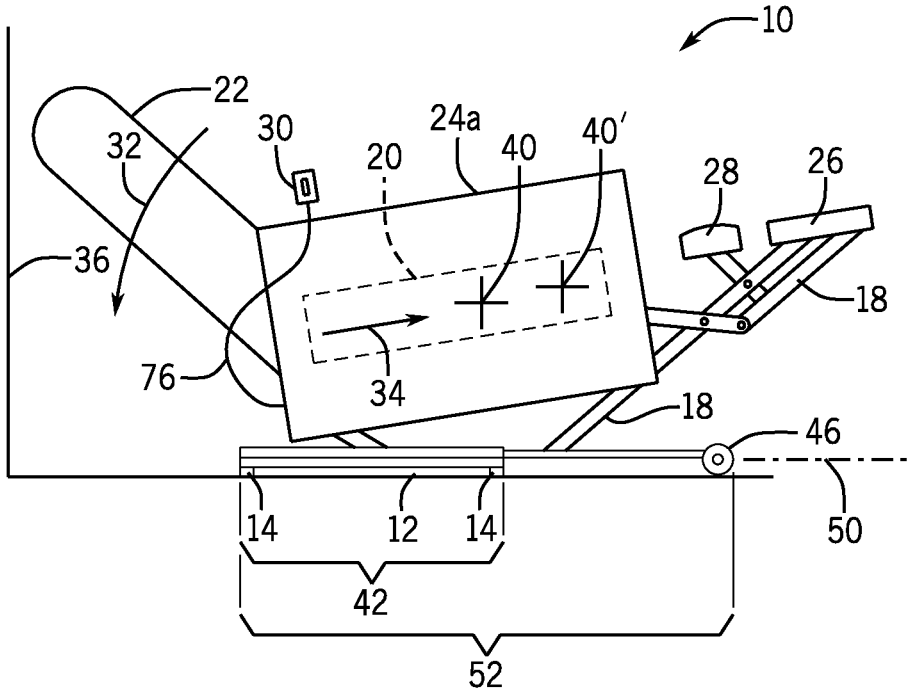

Referring now also to FIGS. 2*a* and 2*b*, in an upright position, as shown in FIG. 2*a*, the seat pan 20 will be generally horizontal and centered above the base 12 with the front surface of the seat back 22 extending upward from a rear edge of the seat pan 20 tipped backward slightly with respect to a vertical plane. In this position, a center of gravity 40 of the chair and a seated individual will generally be low and positioned inside a stability region 42 defined by a region within a rectangle whose vertices are the feet 14.

By activating a pendant control box 30, a seated user (not shown) can cause the chair 10 to move to a reclined position, shown in FIG. 2*b*, with the seat back 22 tipping further backward as shown by arrow 32 and the seat pan 20 moving upward and forward as indicated by arrow 34. This motion of the seat pan 20 prevents the seat back 22 from striking a nearby wall 36 positioned rearward of the chair 10. Typically, as the seat pan 20 elevates and moves forward with respect to the base 12, its front edge rises to follow the elevating calf rest 28 and leg rest 26 folding out from a front surface of the chair 10 below the upper surface of the seat pan 20.

Normally, as the chair 10 reclines, the center of gravity 40 moves forward but remains within the feet 14 in stability region 42. However, if the seated individual shifts forward attempting to exit the reclined chair over the calf rest 28 and 26, the center of gravity may move to center of gravity 40' outside of the stability region 42 causing a tipping of the chair forward and possibly over with possible risk to the occupant.

These features of the reclining chair 10 discussed above are generally understood in the art, for example, as described in U.S. Pat. No. 8,459,732 here by incorporated in its entirety by reference.

Referring still to FIGS. 1 and 2, in the present invention, a reclining of the chair 10 extends stabilizing arms 56 having distal rollers 46 along forward-axis 50 from the base 12. The forward-axis 50 generally passes from a rear to a front of the chair 10 along a midline of the chair 10, and desirably the stabilizing arms flank the midline to be closer to the left and right edges of the reclining chair 10 than to the midline.

The stabilizing arms 56 expand the stability region 42 to an augmented stability region 52 extending forward from the chair, for example, by at least 10 inches and typically more than 12 inches. When the chair 10 is in the upright position, the augmented stability region 52 is only slightly larger in area than stability region 42 as shown in FIG. 2*a*. On the other hand, when the chair 10 is in the reclined position, the augmented stability region increases over the area of the stability region 42 by more than 30 percent and brings the center of gravity 40' into the augmented stability region 52 and thus provides improved stability of the chair 10 in situations involving disembarking by the seated individual.

Notably in both the upright position and the reclined position of the chair 10, the distal rollers 46 are protected under other chair structures defined by the seat pan 20, to be retracted under a front surface of the chair 10 in the upright position, and to be protected beneath the upwardly extended calf rest 28 and leg rest 26 of the chair in the reclined position. This protection reduces tripping hazard from the distal rollers 46 to passersby or individuals assisting those in the chair.

Figure 3:
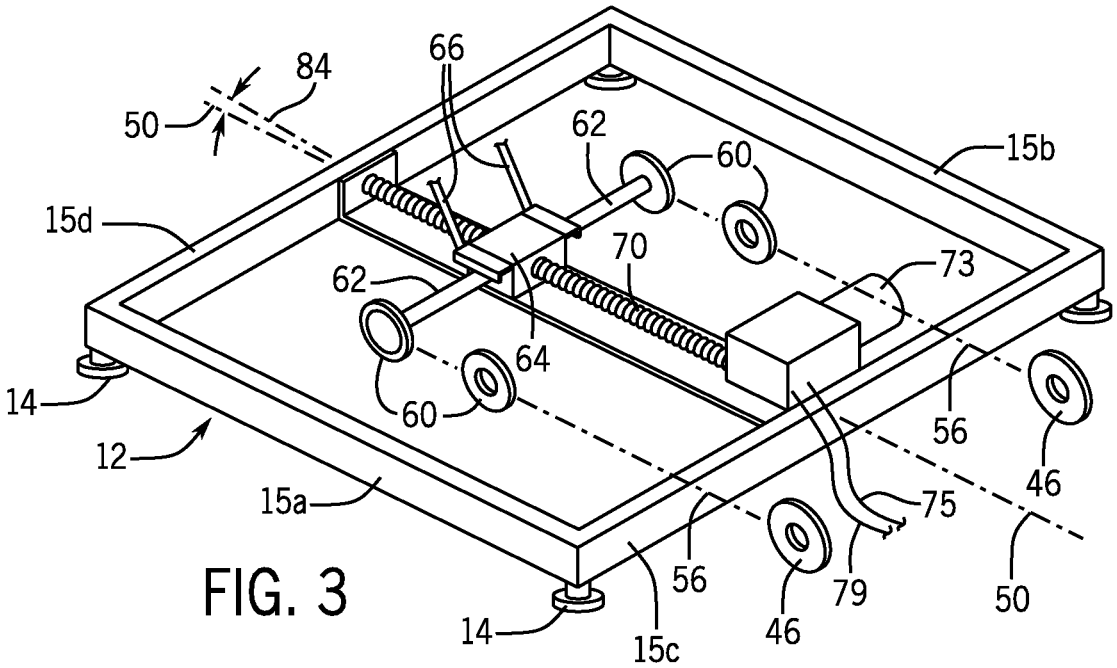
FIG. 3 is a simplified perspective view of the base of the chair of FIG. 1 showing an internal motorized track used to drive the reclining mechanism that may be used also to drive the stabilizing arms.

Referring now to FIGS. 1 and 3, the distal rollers 46 may extend in cantilevered fashion on the stabilizing arms 56 (abstracted to dotted lines for clarity) extending parallel to forward-axis 50 at a right side and left side of the base 12. Generally, the stabilizing arms 56 will be a sturdy metal material to prevent significant flexure of the stability arms 56 when they serve to stabilize the chair 10 against the offset weight of an individual at a center of gravity 40'. The distal rollers 46 may be, for example, ball bearing wheels having an outer soft urethane or other elastomeric coating or outer layer to move along the floor 16 during extension without substantial frictional resistance between the distal rollers 46 and the floor 16 while still maintaining close contact with the floor 16.

The stabilizing arms 56 are connected to support wheels 60 that allow a low friction sliding motion of the stabilizing arms 56 along the forward-axis 50 as depicted between FIGS. 2*a* and 2*b* while resisting upward twisting on the stabilizing arms 56 that would cause them to deviate from their parallel extension with respect forward-axis 50.

A proximal end of the stabilizing arms 56, for example, at the position of a rearward one of the wheels 60, may connect by a wheel axle 62 to a traveler 64 that may be moved by means of a motor 73 along the forward-axis 50. This traveler 64 also communicates via linkage arms 66 with the recliner linkage 18 as is generally understood in the art. The linkage arms 66 may, for example, be equivalent to linkage arms 82 and 80 shown in above-cited U.S. Pat. No. 8,459,732 and may communicate with a structure similar to the recliner linkage 18 discussed in that patent.

Generally, the traveler 64 may be driven by a lead screw 70 extending along forward-axis 50 and turned by the motor 73 receiving power from a power cable 75 and a signal along signal line 79 from control box 30 (shown in FIG. 2*b*).

Figure 4:
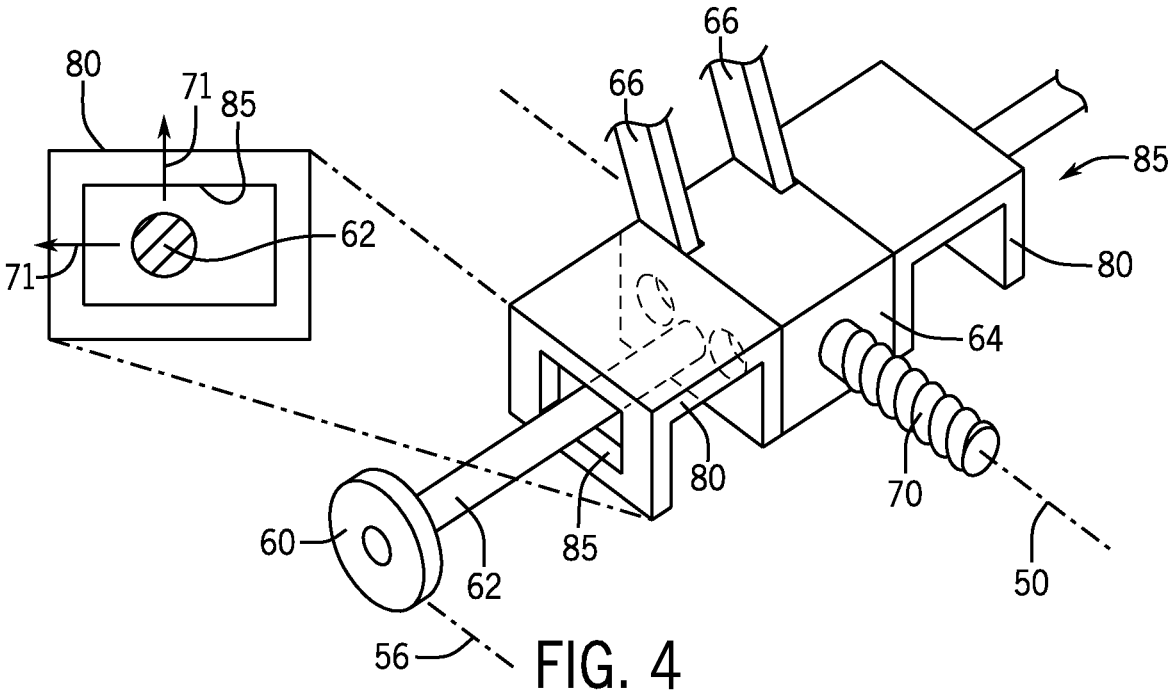
FIG. 4 is a perspective, fragmentary view of a traveler of the internal motorized track as attached to the stabilizing arms using a linkage which accommodates deviation in the motion of the traveler with respect to the motion of the stabilizing arms and showing, in inset, an elevational, cross-sectional view of a portion of that linkage.

Referring now to FIG. 4, the traveler 64 may provide left and right extending C channel brackets 80 opening downward. Each bracket 80 has one side of the C channel bolted to a corresponding side of the traveler 64 and the other side presenting outwardly exposed aperture 82. This aperture 82 may receive the wheel axle 62, described above, to move a respective stabilizing arm 56 with motion of the traveler 64 to allow a slight degree of relative motion 71 in two perpendicular directions between the wheel axle 62 and the traveler 64 that accommodates with a slightly different trajectory between the lead screw 70 indicated by trajectory 84 and the horizontal trajectory of forward-axis 50 along which the stabilizing arms 56 extend. It will be appreciated that this aperture 82 may also allow relative motion between the wheel 60 and stabilizing arm 56 and the traveler 64 when the traveler 64 is on a pivoting track, for example, as occurs when the reclining chair 10 allows rocking in its reclining or upright position.

Figure 5:
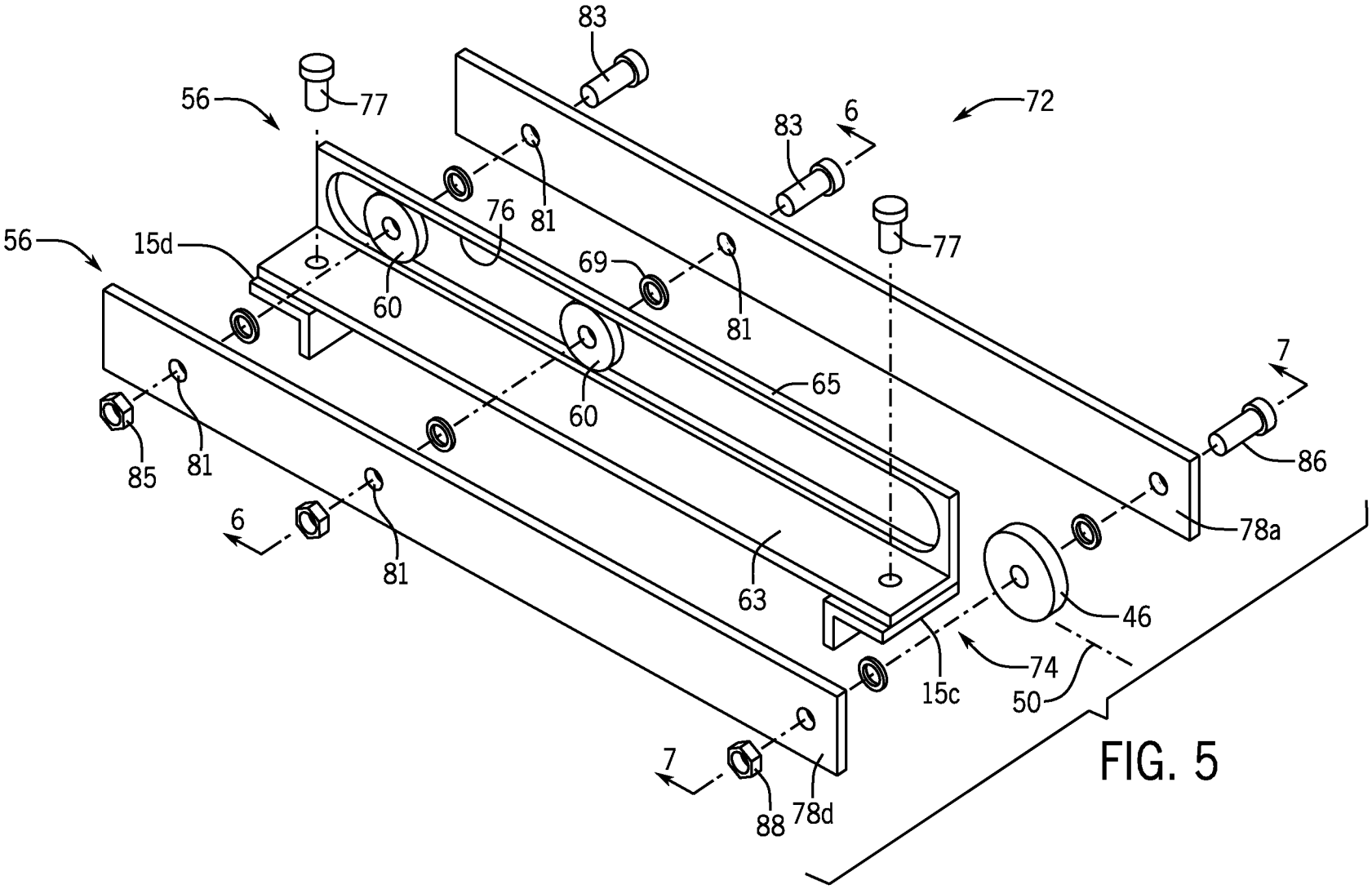
FIG. 5 is an exploded, perspective view of one assembly of one stabilizing arm showing a supporting track structure.
Figure 6:
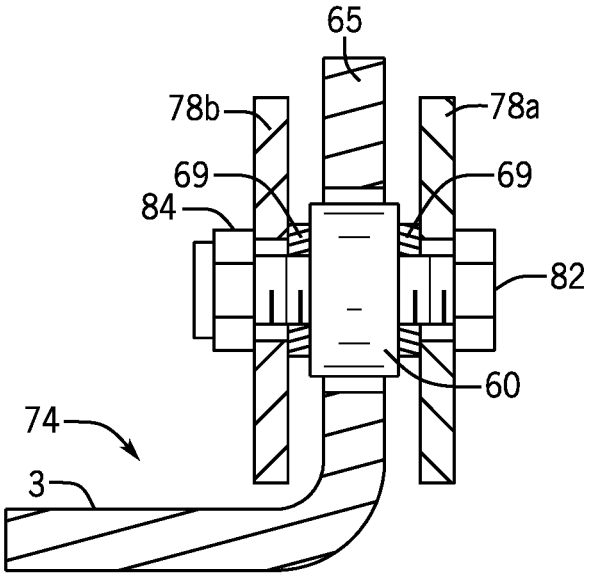
FIG. 6 is a cross-section of FIG. 5 along line 6-6, showing the tandem plates of the stabilizing arms.
Figure 7:
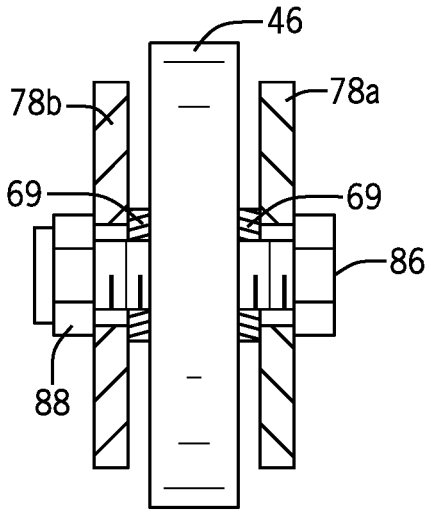
FIG. 7 is a cross-sectional view taken along line 7-7 of FIG. 5 showing the tandem plates flanking a distal roller for contact with the floor.

Referring now to FIGS. 5-7, in one embodiment of the invention, the stabilizing arms 56 are each supported by an independent track 72 that may be installed in a wide range of currently manufactured reclining chairs 10 as manufactured or in a retrofit capacity. Each track system 72 may, for example, provide for an L-shaped angle bracket 74 positioned to be extending parallel to the forward-axis 50 along the length of the base 12 on either side of the track traveler 64. A first web 63 of the angle bracket 74 may be positioned to extend horizontally with a first side positioned to abut an upper surface of the base 12 and be attached thereto by bolts 77 and tapped holes in the base 12 or with corresponding nuts (not shown). This positioning takes advantage of the space available in a large number of reclining chairs 10 and can be done on a retrofit basis by drilling the necessary holes or by providing adapters to allow the existing holes in a given base 12 to be utilized for this purpose.

A second web 65 of the angle bracket 74 may extend upward and may have a slot 76 extending parallel to the forward-axis 50 in size to receive therein the wheels 60 to guide those wheels in a straight line parallel to the forward-axis 50. A left and right tandem plate 78*a* and 78*b* may be positioned on flanking sides of the second web 65 of the angle bracket 74 and may incorporate two rearward holes 81 receiving bolts 83 that provide axles for the wheels 60. The axles are positioned to space the wheels 60 laterally to provide good leverage for torque resistance to the arm 56 formed by these tandem plates 78. Nuts 85 may be attached to the bolts 83 as so installed passing through both of the tandem plates 78 to draw the flanking plates into close proximity to either side of the second web 65 to retain the wheels 60 within the slot 76 and to resist lateral torsion left to right on the stabilizing arms 56. To prevent friction between the plates 78 and the wheels 60, washers 69 may be placed between the plates and the wheels 60.

Figure 8:
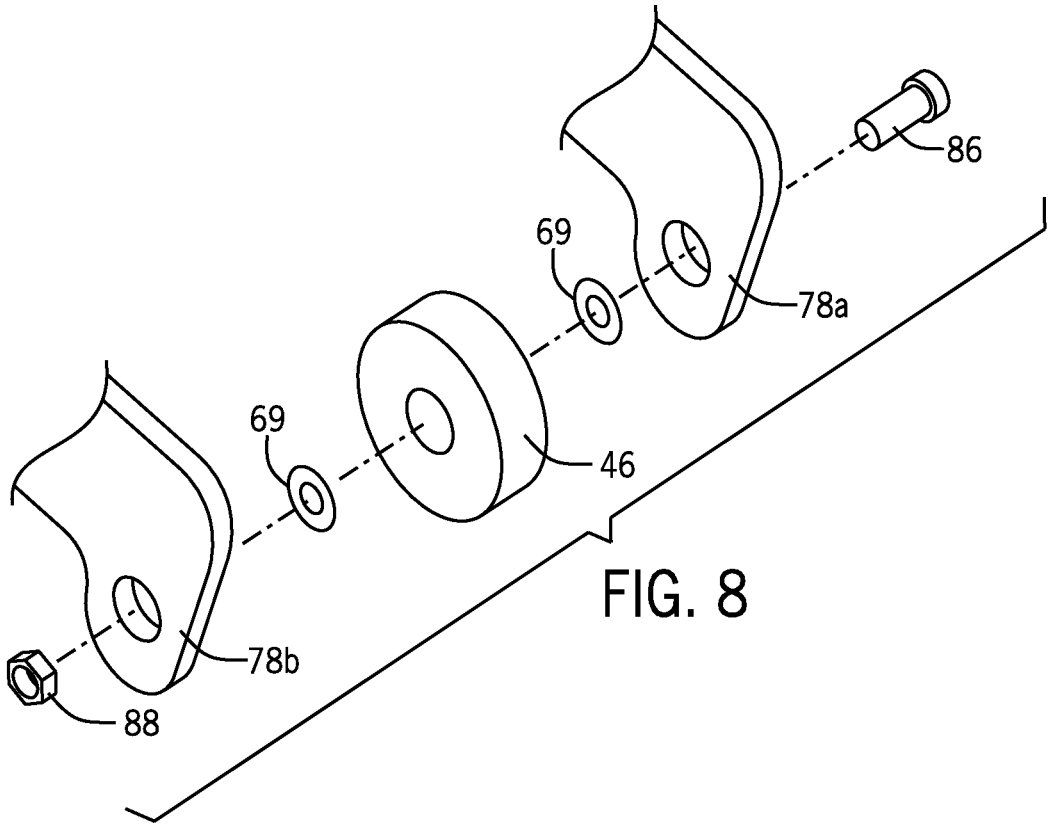
FIG. 8 is a fragmentary detail showing an alternative design of the tandem plates allowing vertical offset of the distal roller for improved compatibility with existing recliner chairs.

The distal rollers 46 may likewise be captured between distal ends of the tandem plates 78 and provided with an axle by a bolt 86 and corresponding nut 88 tightening the tandem plates 78 against the opposite sides of the distal rollers 46 spaced by washers 69 for free rotation of the distal rollers 46. These distal rollers 46 may be larger than the wheels 60 and sized so that they may extend downward into contact with the floor 16 despite the upward offset of the slot 76 by the intervening base 12 and angle bracket 74. Alternatively, as shown in FIG. 8, ends of the tandem plates 78 may be angled downwardly to displace the axle of distal rollers 46 vertically downward with respect to the axles of wheel 60 to provide a similar effect.

The use of spaced apart tandem plates 78 provides improved torsion resistance, and improved resistance to upward bending reducing the tendency of the chair to tip to its side.

Figure 9:
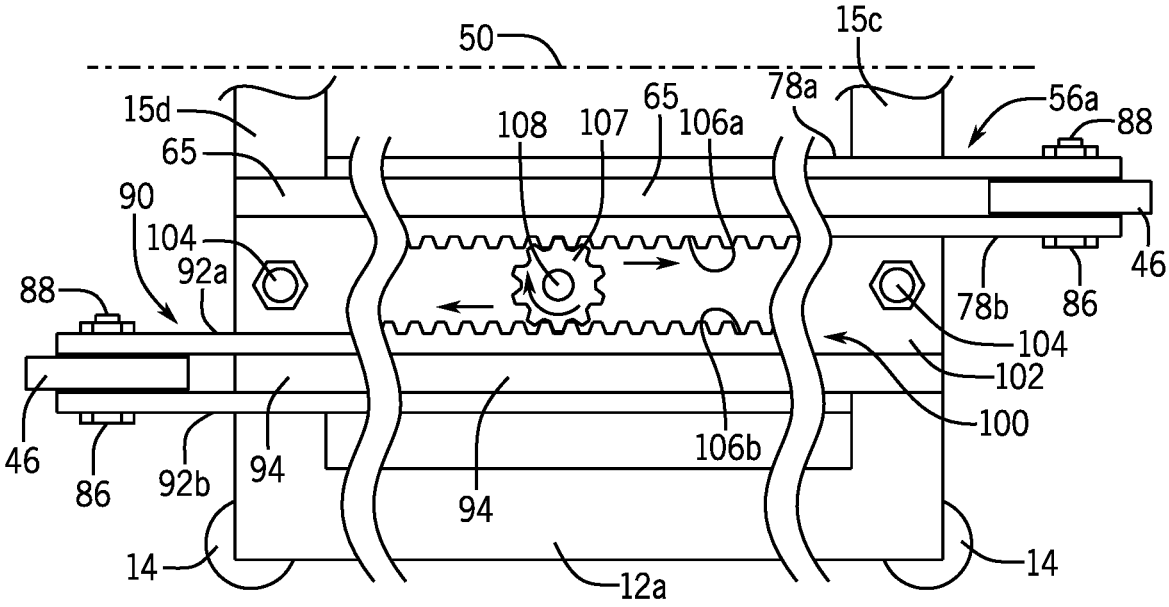
FIG. 9 is a fragmentary top plan view of the base of the chair shown in FIG. 3 providing for a forward and rearward facing track linked by a rack and pinion system so that the forwardly extending track causes the rearwardly extending track to extend simultaneously.
Figure 10:
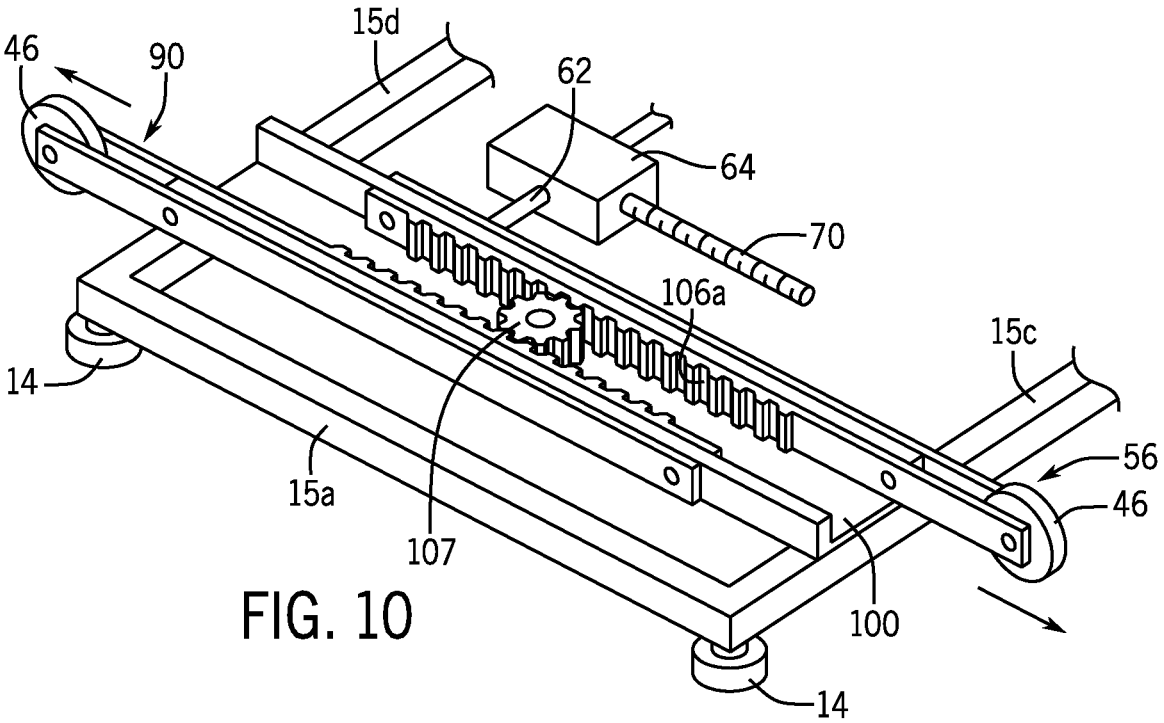
FIG. 10 is a fragmentary perspective view similar to FIG. 3 showing the double track system of FIG. 9 and the directions of extension forward and rearward from the chair.

Referring now to FIGS. 9 and 10, the present mechanism may be readily adapted to provide a forwardly extending arm 56, as described above, operating in tandem with a rearwardly extending arm 90 that provides protection against the chair 10 tipping backwards as well as forward. The rearwardly extending arm 90 may be substantially identical to the forwardly extending arm 56 described above, having its own distal wheel 46 held by a bolt 86 and nut 88 between flanking plates 92*a* and 92*b*, the latter substantially identical to plates 78*a* and 78*b* however flipped 180 degrees about a vertical axis.

The plates 92*a* and 92*b* may flank a third web 94 extending upwardly like web 65 and parallel to web 65 but displaced rightward therefrom. In this case, both the third web 94 and web 65 may be upwardly extending webs of a common C-channel 100 having a spanning base 102 that may be bolted to the base 12 by bolts and nuts 104. The rearwardly extending arm 90 may have internal wheels 60 (not visible in the figures) analogous to wheels 60 for arm 56 and fitting within a corresponding slot 76 through the third web 94 and similar to the slot 76 in the second web 65.

Opposed inner and vertical faces of plates 78*b* and 92*b* may support corresponding racks 106*a* and 106*b* whose teeth extend toward each other separated by a gap that is filled by a pinion gear 107. The pinion gear 107 may be supported for free rotation on a vertical shaft 108 attached to the base 102 of the C-channel 100 and extending vertically therefrom about which the pinion gear 107 rotates. It will be appreciated that movement of the arm 56 forward along axis 50 will cause a clockwise rotation of the pinion gear 107 in turn causing the rearwardly extending arm 90 to move rearwardly by an equal amount.

The pair of arms 56 and 90 as shown in FIGS. 9 and 10 on the right side of the chair 10 may be repeated on the left side of the chair 10 in the manner of the arm 56 described in the previous figures to provide improved robustness and resistance to left and right tipping.

Figure 11:
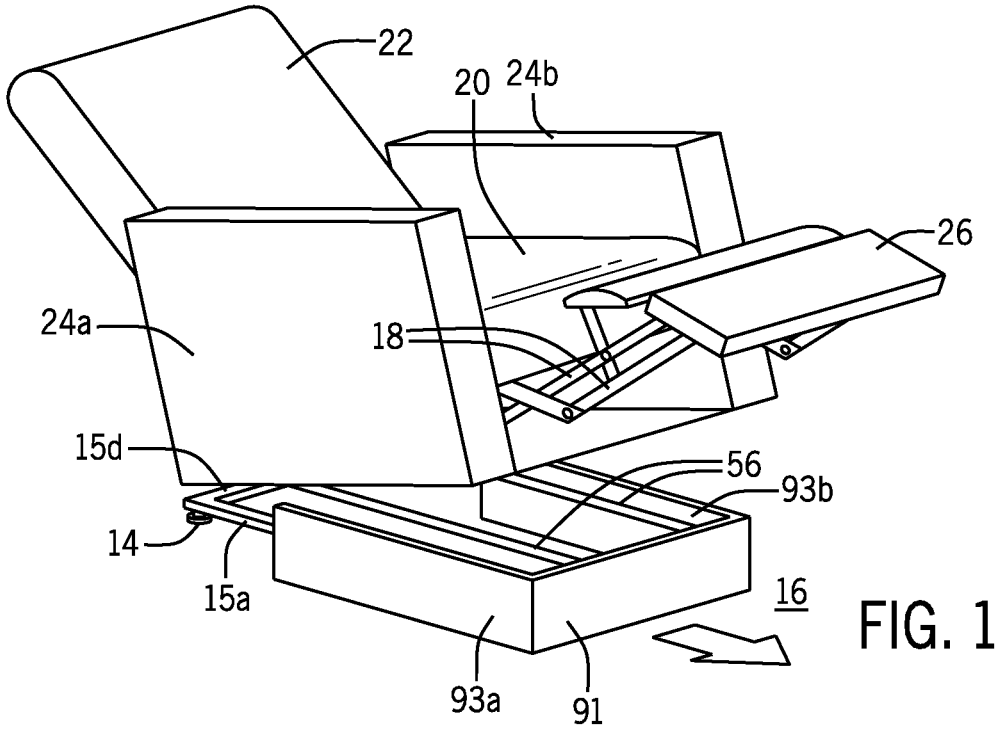
FIG. 11 is a figure similar to FIG. 1 showing a skirt wall placed around the stabilizing arms for improved aesthetics and force spreading.

Referring now to FIG. 11, in one embodiment the distal ends of the arms 56 may support a front, vertically oriented panel 91 sized to extend across the left or right width of the base 12 perpendicular to the extent of the arms 56. The left and right vertical edges of the front panel 91 attach to corresponding edges of rearwardly extending right and left side panels 93*a* and 93*b*, respectively, passing along an outside of frame bars 15*a* and 15*b* (visible in FIG. 3), respectively. The front panel 91 and left and right side panels 93*a* and 93*b* may move with the arms 56 to provide a skirt surrounding the arms 56 visually and blocking a region beneath the leg rest 26 to keep this area clear from loose objects that might interfere with the leg rest 26 during retraction. The front panel 91 may also provide an increased area of contact between the arms 56 and the floor 16 for improved stability and support of the chair 10. Glides or wheels (not shown) may be installed on the lower edges of the front panel 91 and side panels 93 to reduce friction with the floor 16 during extension and retraction.

Figure 12:
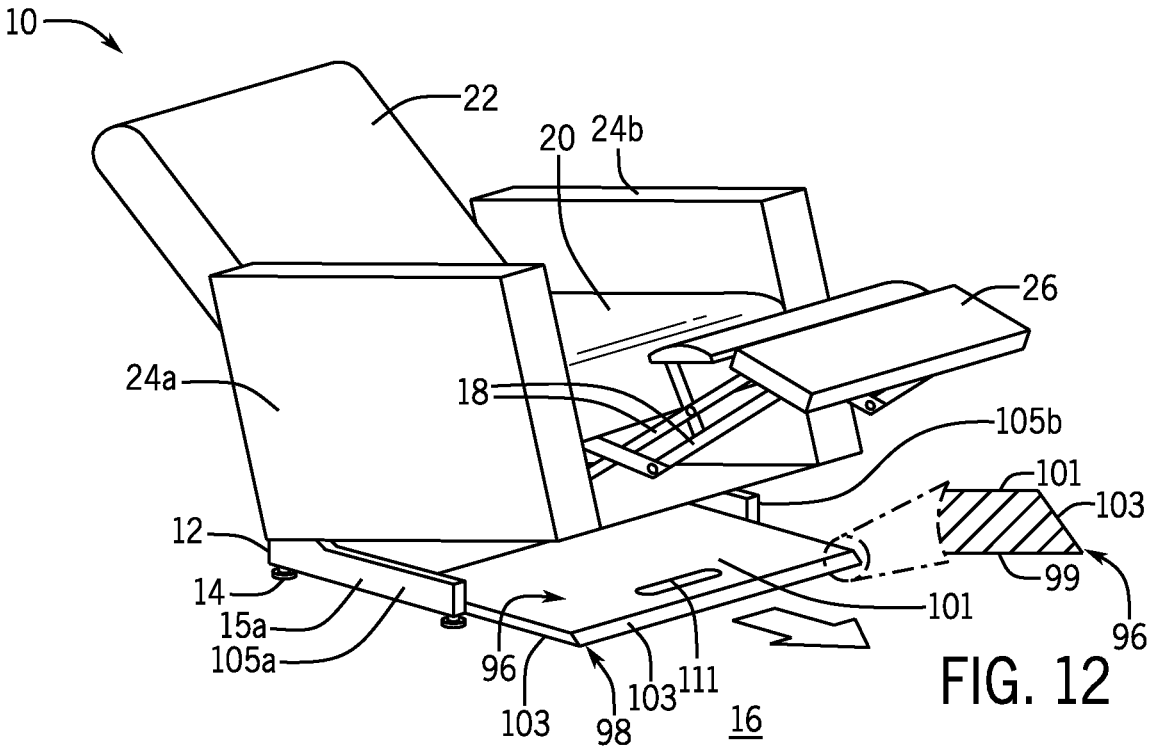
FIG. 12 is a figure similar to FIG. 1 showing an alternative design employing a low-profile panel providing a forward bracing with reduced interference with a user's or caregiver's feet and showing a fragmentary cross-section of that panel as in inset.

Referring now to FIG. 12 in an alternative embodiment, the arms 56 may be replaced with a generally flat panel 96 presenting a planar lower surface 98 that may closely abut the floor 16 during extension of the panel 96 and an upper surface 101 providing a stable and sturdy surface that may be stepped on without consequence when the panel 96 is fully extended. Desirably the lower surface 98 and upper surface 101 of the panel are separated by a reduced height being less than 2 inches and desirably less than 1 inch. Edges 103 of the panel may be beveled to reduce the risk of a user's feet catching on those edges 103 when stepping onto the upper surface 101 of panel 96. The upper surface 101 of the panel 96 is preferably substantially continuous except for a handhold 111 which may be used to extend or retract the panel 96 when manual extension and retraction is desired.

Figure 13:
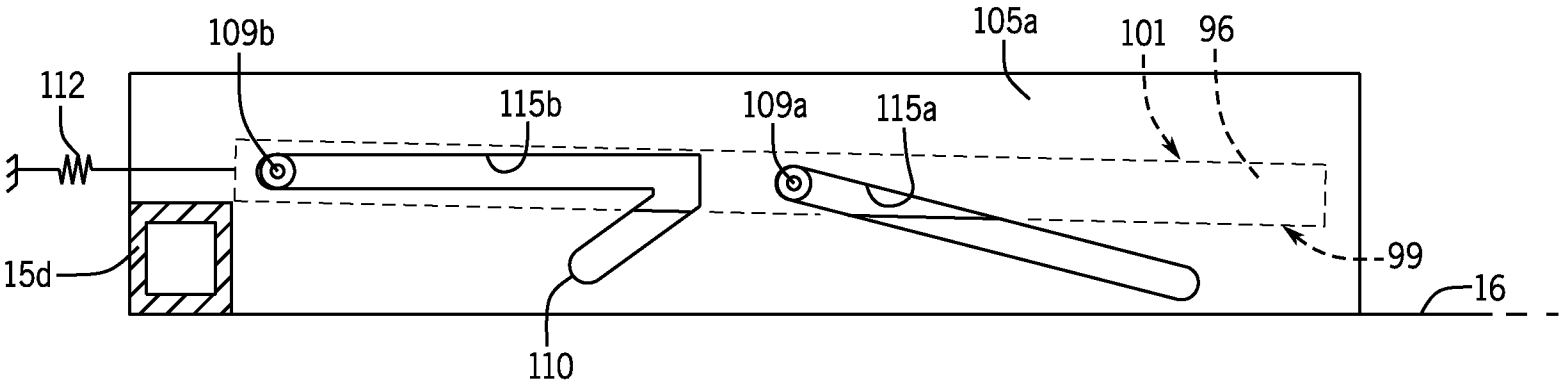
FIGS. 13 and 14 are fragmentary side views in phantom of the track assembly allowing retraction (FIG. 13) and extension (FIG. 14) of the low-profile panel of FIG. 12.

Referring now to FIG. 13, the panel 96 may fit within the left and right side vertically extending sleeves 105*a* and 105*b* attached to the base 12, for example, by bolts (not shown) or the like connecting with rear bar 15*d* and side bars 15*a* and 15*b*, respectively. In this embodiment, front bar 15*a* may be removed to eliminate interference with the panel 96.

Figure 14:
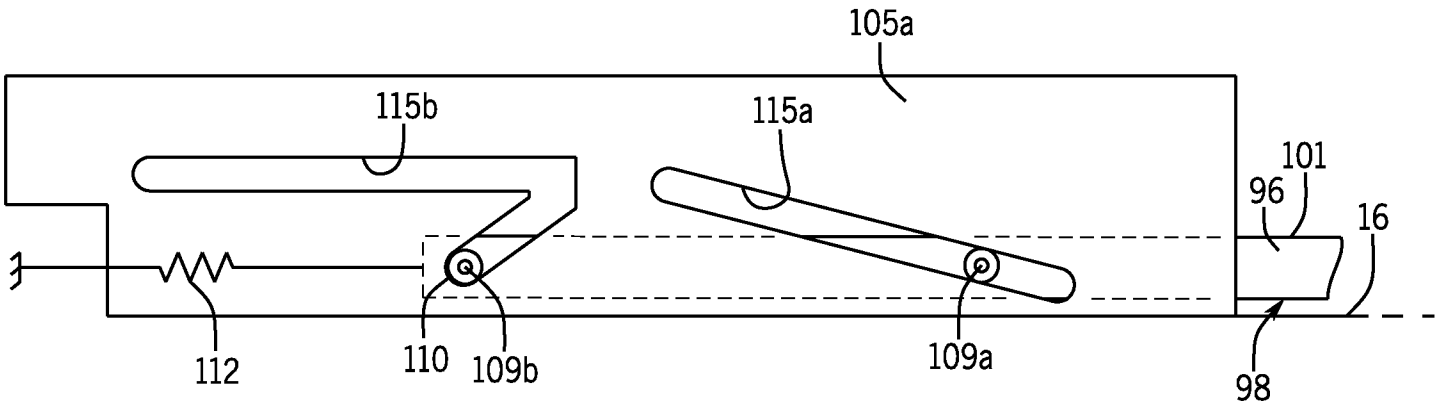

From each side of the panel 96, front and rear guide rollers 109*a* and 109*b* may extend leftwardly and rightwardly from the panel 96 to be received by corresponding front and rear slots 15*a* and 115*b* in the vertically extending sleeves 105*a* and 105*b*, respectively. The front slots 115*a* may angle downwardly so that the front edge of the panel 96 approaches the floor 16 at its full extension position to just contact the floor at that full extension position. The rear slot 115*b* may be substantially horizontal until its frontmost edge at which it may drop downwardly and hook rearwardly to a detent position 110. As shown in FIG. 14, when the rear roller 109 drops into the detent position, the panel 96 may be approximately horizontal and abut the floor over its entire lower surface 98. A restoring spring 112 attached to the rear edge of the panel 96 provides a rearward bias holding that panel in this lower horizontal position where the panel 96 may resist forward tipping of the chair 10.

The panel 96 may be retracted back under the chair 10 by pulling the panel 96 forward against the biasing spring 112 and guiding the rear roller 109*a* upward back into the horizontal upper portion of the rear slot 115*b* allowing full retraction of the panel 96. Other extraction and retention mechanisms are contemplated, and it will be understood from the above description that the panel 96 may also be attached to the recliner mechanism to extend automatically with movement of the recliner chair 10 between its reclined and upright positions.

Figure 15:
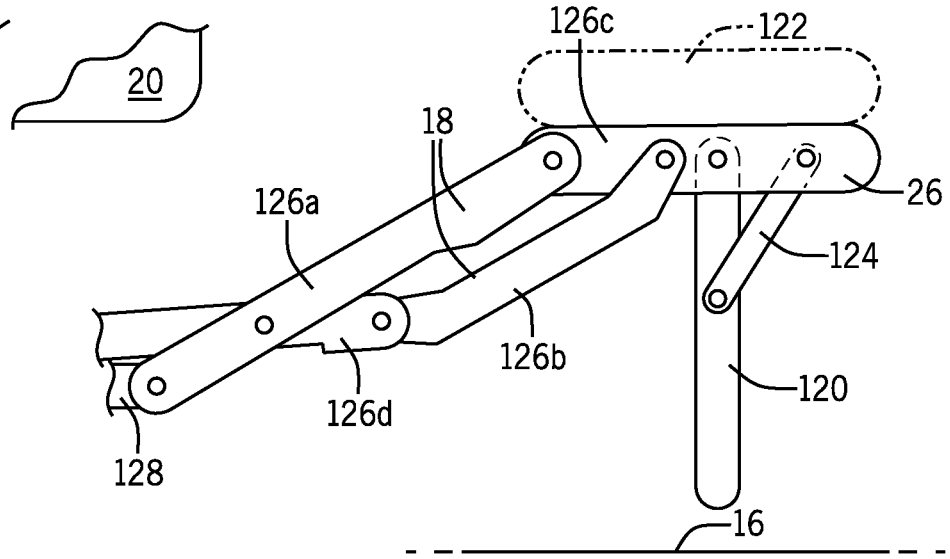
FIGS. 15 and 16 are fragmentary side elevational views of alternative embodiments of a stabilizing feature employing a stilt extending from the bottom of the footrest shown with the footrest extended in FIG. 14 and with the footrest retracted in FIG. 15.
Figure 16:
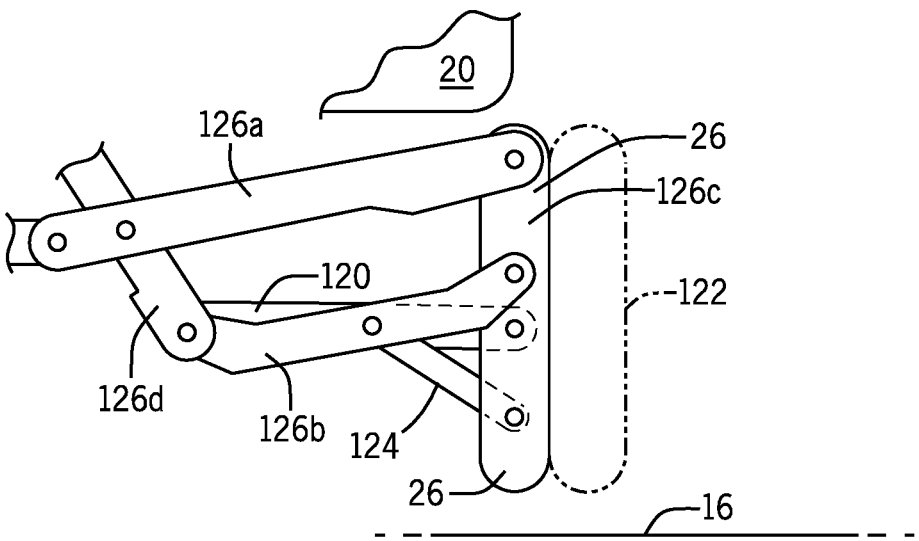
Figure 17:
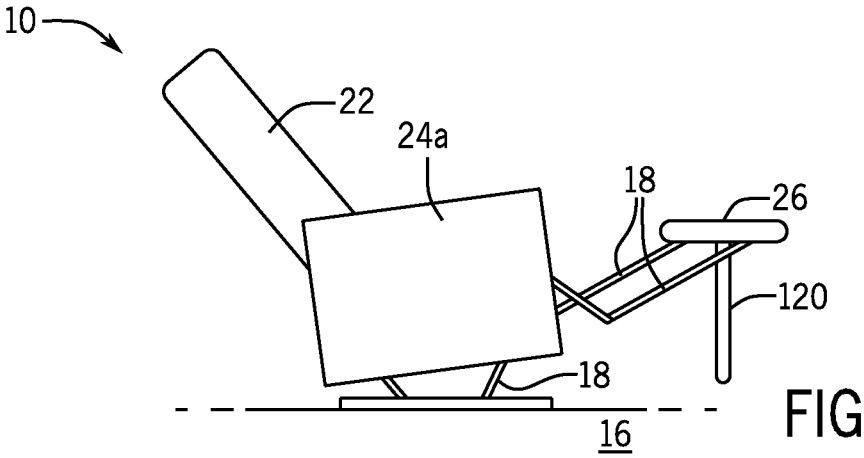
FIG. 17 is a simplified side elevational view of the entire chair and footrest in the extended position of FIG. 14.

Referring now to FIGS. 15, 16, and 17, in an alternative embodiment, the leg rest 26 may provide for a downwardly extending stilt 120 so that when the leg rest 26 is in an extended state as shown in FIG. 15 with the leg-supporting surface of the leg rest 26 extending generally horizontally with a cushion 122 upward, the stilt 120 is substantially perpendicular and vertically downwardly extending from a lower surface of the leg rest 26 to a point touching or closely adjacent to the floor 16. The stilt 120 may be rigidly attached to the leg rest 26, for example, using a cross brace 124 or may fold out from the leg rest 26 and be locked into position with the detent (not shown). As is generally understood in the art, the leg rest 26 is attached by means of the recliner linkage 18 which provides a pantograph or four bar linkage that moves the leg rest 26 into a substantially vertical position as the leg rest 26 is withdrawn to the retracted position close to the recliner chair 10 under the seat pan 20 as shown in FIG. 16. Generally, the pantograph linkage will include four linkage bars of 126*a* and 126*b* having first ends pivotally attached to the leg rest 26 at displaced locations along the leg rest 26, the space between these attachment locations defining linkage bar 126*c*. A final linkage bar 126*d* is pivotally attached to the remaining ends of linkage bars 126*a* and 126*b* completing the four-bar linkage. The four-bar linkage communicates with the remainder of the recliner linkage 18 through a continuation of bar 126*d* and by additional linkage bars 128 attached pivotally to the remaining end of linkage bar 126*a*.

When the leg rest 26 is in the retracted position, the stilt 120 swings rearwardly and horizontally to fit beneath the seat pan 20 by the action of the recliner linkage 18 while fixed relative to the leg rest 26. Referring also to FIG. 17 in the extended position shown also in FIG. 15 the stilt 120 prevents downward motion of the leg rest 26 while the recliner linkage 18 is in an extended position thus providing a bracing of the chair 10 against a forward tipping particularly if weight is placed on the leg rest 26. In this case, with weight placed directly on the leg rest 26, the stilt 120 absorbs that weight without the need for strength in the linkage 18 other than to hold the orientation of the leg rest 26.

The use of the term chair should be understood broadly to include furniture that functions as a chair including, for example, couches, sectionals, and the like.

Certain terminology is used herein for purposes of reference only, and thus is not intended to be limiting. For example, terms such as "upper", "lower", "above", and "below" refer to directions in the drawings to which reference is made. Terms such as "front", "back", "rear", "left", "right", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

I claim:

1. A reclining chair comprising:

a base frame;

a seat pan, a seat back, and leg rest mechanism supported by the base frame, wherein the leg rest mechanism includes a leg rest platform movable relative to the base frame between a retracted position and an extended position extending forward from the base frame; and a pair of extendable arms each having distal ends movable between a retracted position and an extended position in which the distal ends move forward from the base frame so that the distal ends contact a floor surface on which the base frame rests at left and right positions in front of the base frame to resist forward and sideward tipping of the base frame on the floor; and wherein the distal ends of the arms are joined to proximal ends of the arms by a telescopic slide joint constraining motion of the distal ends in extension from the base frame along a line and wherein the telescopic slide joint inter-communicates between the proximal and distal ends of the arms with rollers guiding the distal ends with respect to the proximal ends.

2. The reclining chair of claim 1 wherein the arms are attached to the base frame at left and right sides of the base frame to be closer to the left and right sides, respectively, than a midline of the base frame halfway between the left and right sides.

3. The reclining chair of claim 1 wherein the rollers are wheels turning about a central axle fixed with respect to one of the distal and proximal ends and having an outer periphery of an elastomeric material.

4. The reclining chair of claim 1 wherein the base frame provides floor glides supporting the base frame against the floor and the distal end of the arms provides a roller sized to provide rolling contact with the floor during extension.

5. The reclining chair of claim 1 wherein the retracted position of the distal ends is beneath the seat pan.

6. The reclining chair of claim 1 wherein the extended position extends the distal ends of the arms at least 12 inches.

7. A reclining chair comprising:

a base frame;

a seat pan, a seat back, and leg rest mechanism supported by the base frame, wherein the leg rest mechanism includes a leg rest platform movable relative to the base frame between a retracted position and an extended position extending forward from the base frame; and a pair of extendable arms each having distal ends movable between a retracted position and an extended position in which the distal ends move forward from the base frame so that the distal ends contact a floor surface on which the base frame rests at left and right positions in front of the base frame to resist forward and sideward tipping of the base frame on the floor; and wherein distal ends of the arms are joined to proximal ends of the arms by a telescopic slide joint constraining motion of the distal ends in extension from the base frame along a line and the proximal ends of the arms are releasably attached to the base frame; and wherein the base frame provides a front and rear bar element at the front and rear sides of the reclining chair, respectively, communicating on left and right edges with chair feet and wherein each of the proximal ends of the arms attaches to both the front and rear bar elements.

8. A reclining chair comprising:

a base frame;

a seat pan, a seat back, and leg rest mechanism supported by the base frame, wherein the leg rest mechanism includes a leg rest platform movable relative to the base frame between a retracted position and an extended position extending forward from the base frame; and a pair of extendable arms each having distal ends movable between a retracted position and an extended position in which the distal ends move forward from the base frame so that the distal ends contact a floor surface on which the base frame rests at left and right positions in front of the base frame to resist forward and sideward tipping of the base frame on the floor; and wherein the base frame communicates through a linkage joining the seat back and leg rest mechanism to move the seat back between a forward and reclined position and the leg rest platform between the retracted and extended position and wherein the arms are attached to linkage to move in extension when the seat back moves to the reclining position and the leg rest moves to the extended position; and wherein the linkage provides a motorized traveler moving along a traveler axis by actuation of a motor and wherein the first and second arms are attached to the traveler; and wherein the first and second arms are attached on opposite left and right sides of the traveler to extend along axes aligned with the traveler axis.

9. A reclining chair comprising:

a base frame;

a seat pan, a seat back, and leg rest mechanism supported by the base frame, wherein the leg rest mechanism includes a leg rest platform movable relative to the base frame between a retracted position and an extended position extending forward from the base frame; and a pair of extendable arms each having distal ends movable between a retracted position and an extended position in which the distal ends move forward from the base frame so that the distal ends contact a floor surface on which the base frame rests at left and right positions in front of the base frame to resist forward and sideward tipping of the base frame on the floor;

further including a skirt frame attached to the distal ends of the arms and providing a front vertically extending panel also extending perpendicularly to the arms beyond the arm's left and right edges, and left and right side vertically extending panels also extending rearwardly from the left and right edges of the front panel by a distance being equal to a distance between the front vertically extending panel and the base when the pair of extendable arms are in the extended position, the front panel moving proximate to a front of the base and the left and right side panels fitting around the left and right sides of the base when the arms are in the retracted position, and the lower edge of the skirt frame extending below the arms to a position adjacent to the floor.

10. A reclining chair comprising:

a base frame;

a seat pan, a seat back, and leg rest mechanism supported by the base frame, wherein the leg rest mechanism includes a leg rest platform movable relative to the base frame between a retracted position and an extended position extending forward from the base frame; and a first pair of extendable arms each having proximal ends attached to the base frame and distal ends movable between a retracted position and an extended position in which the distal ends move forward from the base frame in the extended position so that the distal ends contact a floor surface on which the base frame rests at left and right positions in front of the base frame to resist forward and sideward tipping of the base frame on the floor; and further including a second pair of extendable arms having proximal ends attached to the base frame and having distal ends movable between a retracted position and an extended position with respective movement-of the first pair of extendable arms between the retracted position and the extended position, in which the distal ends move rearward from the base frame in the extended position so that the distal ends contact a floor surface on which the base frame rests at left and right positions behind the base frame to resist rearward and sideward tipping of the base frame on the floor.

11. The reclining chair of claim 10 wherein the pair of extendable arms and the second pair of extendable arms are mechanically interlinked to move between extended and retracted positions in unison.

12. A reclining chair comprising:

a base frame;

a seat pan, a seat back, and leg rest mechanism supported by the base frame, wherein the leg rest mechanism includes a leg rest platform movable relative to the base frame between a retracted position and an extended position extending forward from the base frame; and a flat panel presenting a lower surface and an upper surface supporting the weight of an individual stepping on the upper surface, the panel having a thickness between the upper surface and lower surface of less than 2 inches and further having a proximal edge attached to the base frame to move a distal edge of the panel between a retracted position and an extended position extending forward from the base frame so that the distal edge of the panel contacts a floor surface on which the base frame rests, along a length of the edge to resist a forward tipping of the base frame on the floor with a lower panel surface substantially abutting the upper surface of the floor and an upper panel surface substantially parallel to the floor.

13. A reclining chair comprising:

a base frame;

a seat pan, a seat back, and leg rest mechanism supported by the base frame, wherein the leg rest mechanism provides a leg rest platform and includes a pantograph linkage movable relative to the base frame between a retracted position and an extended position extending forward from the base frame to hold the leg rest platform in horizontal extension spaced away from the base frame in front of the base frame in the extended position and in vertical extension adjacent to the front of the base frame in the retracted position; and a stilt attached to the leg rest mechanism to extend downward from an undersurface of the leg rest platform when the pantograph linkage is in the extended position to a point proximate to a floor supporting the base frame, the stilt adapted to resist a forward tipping of the base frame on the floor; and wherein the base frame communicates through a linkage joining the seat back and leg rest mechanism to move the seat back between a forward and reclined position and the leg rest platform between the retracted and extended position and wherein the stilt is moved by the linkage to extend downward when the seatback is in the reclined position and to be retracted from contact with the floor when the seatback is in the forward position.

14. The reclining chair of claim 13 wherein the stilt mechanism is fixedly attached relative to the leg rest platform so as to not rotate with respect to the leg rest platform.

* * * * *